United States Patent [19]

Frye et al.

[11] 4,210,247

[45] Jul. 1, 1980

[54] FOLDED SHEETS OF WRAPPING PAPER

[75] Inventors: Dana E. Frye; Russell G. Novcaski; Jack Mills; Richard H. Horneck, all of Appleton, Wis.

[73] Assignee: Fox Valley Corporation, Appleton, Wis.

[21] Appl. No.: 9,647

[22] Filed: Feb. 5, 1979

[51] Int. Cl.[2] ..... B65D 85/62

[52] U.S. Cl. ..... 206/494; 206/215; 206/449

[58] Field of Search ..... 206/494, 449, 215

[56] References Cited

U.S. PATENT DOCUMENTS

| | | | |
|---|---|---|---|
| 3,143,762 | 3/1979 | Spiegelberg | 206/494 |
| 3,684,086 | 8/1972 | Harrison | 206/449 |
| 3,819,043 | 6/1974 | Harrison | 206/449 |
| 4,064,990 | 12/1977 | Bennett | 206/494 |

*Primary Examiner*—William T. Dixson, Jr.

*Attorney, Agent, or Firm*—Kinzer, Plyer, Dorn & McEachran

[57] ABSTRACT

A nest of folds of decorative wrapping paper. Each fold includes at least one sheet of wrapping paper which has one printed decorative surface and one unprinted surface. A first fold of paper is creased longitudinally into a flat V-shaped configuration having two panels of approximately equal width. A second fold of paper is creased longitudinally into a flat Z-shaped configuration having three panels. These three panels include a center panel having the same width as a panel of the first fold and two side panels, one of which is one-third and the other of which is two-thirds as wide as the center panel. A third panel is creased in the same configuration as the second fold. The nest is assembled with the center panels of the folds superimposed upon one another the two-thirds width side panels being positioned immediately outwardly of the center panels on opposite sides of the nest, and the one-third width side panels positioned immediately outward of the two-thirds width side panels on opposite sides of the nest. The assembled folds of the nest being folded in half longitudinally about a laterally extending crease line to form a folded nest in which the outer face on each side presents a shingled appearance in which one-third of each fold is visible.

1 Claim, 3 Drawing Figures

FOLDED SHEETS OF WRAPPING PAPER

SUMMARY OF THE INVENTION

This invention is directed to a nest for three folds of decorative wrapping paper in which equal widths of each fold are visible.

Another object is a nest of folds of decorative wrapping paper which is of uniform thickness.

Another object of this invention is a nest of Z-shaped folds of decorative wrapping material in which the undecorated surfaces of the folds are not visible.

Other objects may be found in the following specification, claims and drawings.

DESCRIPTION OF THE PREFERRED EMBODIMENT

Figure 1:
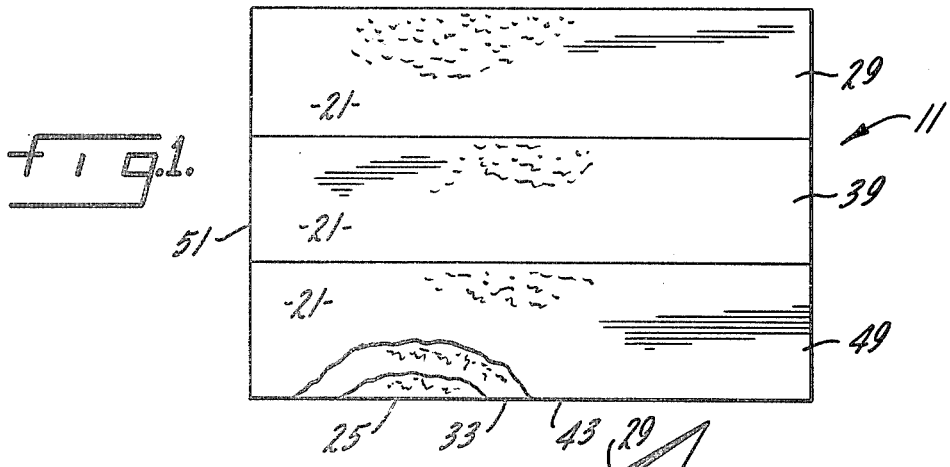
FIG. 1 is a top plan view of a nest of folds of decorative wrapping paper embodying the novel features of this invention.
Figure 2:
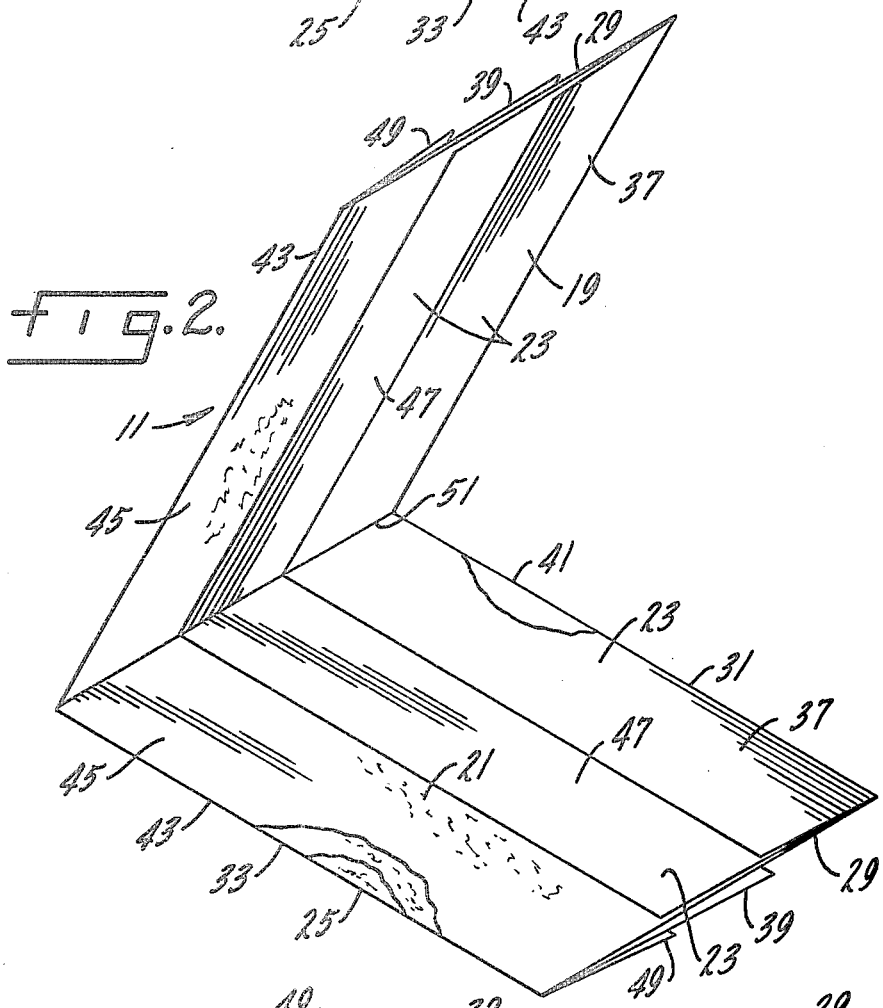
FIG. 2 is a perspective view of a nest of folds of FIG. 1 partially opened.
Figure 3:
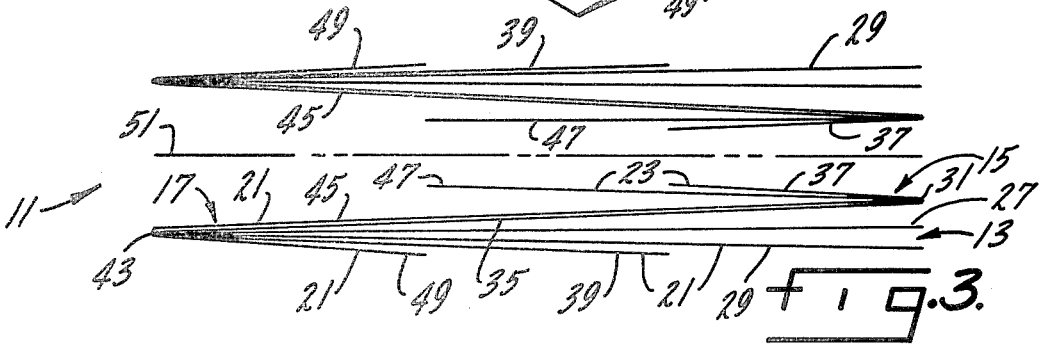
FIG. 3 is a somewhat schematic end view of the nest of FIG. 1 with the folds spread apart to show their interlocking relationship to one another.

The drawings show a nest 11 of decorative wrapping paper assembled from folds of decorative wrapping paper in accordance with the teachings of this invention. Each fold is formed of a single sheet of decorative wrapping paper in the embodiment shown herein, but it should be understood and appreciated that more than a single sheet of paper may be utilized in each fold without departing from the teachings of this invention. Customarily, all sheets of a fold will be of the same design. A number of nests 11 of wrapping paper may be included in a package sealed in a conventional plastic bag which is not shown herein because it does not form a part of this invention.

In this embodiment of the invention, each sheet of decorative wrapping paper is approximately 30 inches long and 20 inches wide and can be cut from a 20, 26 or 30 inch roll of paper. Of course, the sheets of paper can be of any other conventional dimensions depending upon the size of the final package to be constructed. The final dimensions of the nest 11 after folding are approximately 10 inches by 15 inches.

Decorative wrapping paper has a printed design on one surface and unprinted finish on the opposite surface. In a fold, it is desirable that only the printed decorative surface be visible to a would-be purchaser and that the unprinted surface be concealed. Previous folds of paper such as those of S or Z shape of the type shown in Bond, U.S. Pat. No. 1,028,084 are not satisfactory for folds of decorative wrapping paper because the undecorated surface of such a fold would be visible. This invention permits the use of an S or Z shaped fold without exposing the unprinted side of the fold to a would-be purchaser.

The nest 11 includes three folds 13, 15 and 17, each consisting of a single sheet 19 of a decorative wrapping paper. As is conventional, each sheet of paper has a decoratively printed side 21 and an unprinted side 23. Fold 13 is formed by creasing a sheet 19 of paper along a longitudinally extending crease line 25 which divides the sheet into a flat V-shaped configuration having two panels 27 and 29 of equal width of approximately 10 inches. This V-shaped fold is formed with the decoratively printed surfaces 21 of the panels facing outwardly.

Fold 15 is formed by folding a sheet 19 of decorative wrapping paper along two longitudinally extending crease lines 31 and 33 to form a Z-shaped configuration having three panels. The three panels include a center panel 35 having a width of approximately 10 inches and two side panels 37 and 39. Side panel 37 has a width equal to approximately one-third the width of panel 35 or three and one-third inches in this example. Panel 39 is formed with a width equal to two-thirds the width of panel 35 or six and two-thirds inches in this example. Panel 37 is folded about crease line 31 in a position against panel 35 so that its unprinted face 23 faces outwardly. Panel 39 is folded about crease line 33 and up against the opposite side of panel 35 so that its decoratively printed face 21 faces outwardly.

Fold 15 is nested over fold 13 with the panels 35 and 27 respectively being superimposed on each other and with their respective crease lines 33 and 25 being positioned adjacent each other. Panel 39 is lcoated outwardly of panel 29 and overlies two-thirds of panel 29.

Fold 17 is formed in a Z-shaped configuration similar to that of fold 15 but with the relative locations of its side panels reversed. Fold 17 is formed by crease lines 41 and 43 into a center panel 45 which has a width of approximately ten inches, and two side panels 47 and 49. Side panel 47, which is in the same relative position to its center panel 45 as is side panel 37 relative to its center panel 35 of fold 15, is twice as wide as side panel 37 or approximately six and two-third inches wide. Side panel 49 is equal in width to one-third of its center panel 45 or approximately three and one-third inches in this example. Panel 47 is folded about crease line 41 and against panel 45 so that its unprinted face 23 faces outwardly. Panel 49 is folded about crease line 43 so that its decoratively printed face or surface 21 faces outwardly.

Fold 17 is nested over fold 15 with the panels 45 and 35 respectively being superimposed on each other and with their respective crease lines 43 and 33 being positioned adjacent each other. Panel 49 of fold 17 overlies one-half of panel 39 of fold 15 with the decoratively printed surfaces 21 of the folds facing outwardly. Crease line 41 of fold 17 is nested inside crease line 31 of fold 15 so that panel 37 of fold 15 overlies one-half of panel 47 of fold 17 with the unprinted surfaces 23 of both panels facing outwardly.

The nested folds 13, 15 and 17 are then folded in half about a laterally extending crease line 51 so that the panels 37 and 47 which have their unprinted surfaces 23 facing outwardly are concealed in the folded condition of the nest 11. In this folded condition, the decoratively printed surfaces 21 of the panels 29, 39 and 49 face outwardly. Because of the overlapping arrangement of these panels, a shingled effect is obtained with one-third section of each panel being visible to the would-be purchaser.

We claim:

1. A nest of folds of decorative wrapping paper with each fold including at least one sheet of paper, a first fold being creased longitudinally into a flat V-shaped configuration having two panels of approximately equal width, a second fold being creased longitudinally into a flat Z-shaped configuration having three panels, which three panels include a center panel having the same width as a panel of said first fold and two side panels, one of which is one-third and the other of which is two-thirds as wide as the center panel, a third fold being creased in the same configuration as the second fold, said nest being assembled with the center panels of the folds superimposed upon one another, the two-thirds width side panels being positioned immediately outwardly of the center panels on opposite sides of the nest, and the one-third width side panels positioned immediately outward of the two-thirds width side panels on opposite sides of the nest, and the assembled folds of the nest being folded in half longitudinally about a laterally extending crease line to form a folded nest in which the outer face on each side presents a shingled appearance in which one-third of each fold is visible.

* * * * *